US005971898A

United States Patent [19]

Schoolfield

[11] Patent Number: 5,971,898

[45] Date of Patent: Oct. 26, 1999

[54] SLIDING WEIGHT RACK

[76] Inventor: Darrel Schoolfield, 4335 S. Mingo Rd., Tulsa, Okla. 74146

[21] Appl. No.: 09/273,206

[22] Filed: Mar. 19, 1999

[51] Int. Cl.[6] ..... A63B 21/078

[52] U.S. Cl. ..... 482/104

[58] Field of Search ..... 482/93, 94, 104, 482/135

[56] References Cited

U.S. PATENT DOCUMENTS

| | | | |
|---|---|---|---|
| 4,799,672 | 1/1989 | Barrett | 482/104 |
| 5,141,480 | 8/1992 | Lennox et al. | 482/104 |
| 5,215,510 | 6/1993 | Baran | 482/104 |
| 5,350,346 | 9/1994 | Martinez | 482/142 |
| 5,472,397 | 12/1995 | Ammoscato et al. | 482/104 |
| 5,509,876 | 4/1996 | Reyes | 482/104 |
| 5,725,460 | 3/1998 | Marsh | 482/104 |

*Primary Examiner*—John Mulcahy
*Attorney, Agent, or Firm*—Molly D. McKay

[57] ABSTRACT

A sliding weight rack for removably holding free weights provided on a weight lifting bench. The rack is movable, via linear bearings, horizontally relative to the weight lifting bench so that a weight lifter can pull the rack and the weights above the weight lifter's chest. The gas strut provided on the rack will automatically retract the rack to its original rearward position once the weights have been removed from the rack. In its rearward position, the rack is out of the way of the weight lifter but is still easily accessible when the weight lifter is ready to replace the weights onto the rack.

17 Claims, 7 Drawing Sheets

SLIDING WEIGHT RACK

BACKGROUND OF THE INVENTION

1. Field of the Invention

The present invention relates to a movable rack for holding weight lifting equipment. More specifically, the present invention is a sliding weight rack that is provided on a weight lifting bench and is designed to hold free weights. The rack is movable horizontally relative to the weight lifting bench so that a weight lifter can pull the rack toward the weight lifter until it is vertically aligned above the weight lifter. From this position, the weights are directly above the weight lifter and properly aligned so that they can be lifted off of the rack. The rack will automatically retract itself to its original position once the weights have been removed from it so that the rack is out of the way of the weight lifter. The rack retracts to the original position so that it is easily accessible when the weight lifter is ready to replace the weights onto the rack.

2. Description of the Related Art

Working out with weights has become quite popular with the public. With the numerous athletic clubs and health facilities that are available to the public today, it is important that weight lifting equipment be as safe as possible to prevent injury to the many casual users that may be using the equipment.

One of the problems with weight lifting that causes frequent injury is when the weights are not properly positioned relative to the weight lifter when the weights are engaged and when the weights are released. If the weights and the weight lifter are improperly aligned as the weights are engaged, the weight lifter may strain his muscles when he makes the initial lift of the weights. The ideal position for the weights relative to the weight lifter on the initial engagement and lift is with the weights directly above the arms of the weight lifter. However, if a rack is placed above the weight lifter so that the weights are directly above him, once the weights are lifted, the rack is in the way and prevents him from raising the weights directly above his chest since to do so would cause the weights to bump into the rack.

Others have attempted to address this problem by providing racks that swing laterally away from the weight lifter when the weights are initially lifted. Although this type of rack configuration does move the racks out of the way of the weight lifter, the racks move into a position that makes replacing the weights onto the rack awkward, either because the weight lifter must twist his arms in an awkward way while holding the weights or because the weight lifter must use his legs to reposition the rack vertically above him. Either of these movements could cause the weight lifter to strain himself.

The present invention is designed to solve this problem. The present invention is a slidable rack that is attached to a weight lifting bench. The rack is located above the bench and is movable longitudinal relative to the bench. The rack is normally biased in a fully extended rearward position. The rack can be easily pulled, either by grasping the rack or by grasping weights that are resting on the rack, so that the rack and any weights supported thereon, move horizontally. By pulling on the rack or the weights supported thereon, the rack and weights are slid horizontally so that the weights are directly above the bench. When the pulling force is removed, such as when the weights are lifted off the rack, the rack immediately returns to its original, fully extended rearward position. In this position, the weight lifter can easily return the weights to the rack by holding the weights with his arms fully extended and then allowing the weights to move behind the weight lifter's head until the weights come to rest on the horizontal arms of the rack.

SUMMARY OF THE INVENTION

The present invention is slidable rack that is attached to a weight lifting bench by means of a pair of linear bearings that are provided below the bench. The linear bearings are secured to the bench, and the rack is secured to the linear bearing housing. The rack moves horizontally relative to the bench in conjunction with the linear bearing housing. The rack consists of two upright members that extend vertically upward from the linear bearings and each upright member is provided with a pair of horizontal arms. Each pair of horizontal arms is located above the bench and extends in the direction of the bench. Free weights are removably supported on the horizontal arms. The horizontal arms and the rack are movable, via the linear bearings, longitudinally relative to the bench.

The rack is normally biased in a fully extended rearward position by means of a gas strut provided under the bench and secured to both the rack and the bench. The rack can be easily pulled, either by grasping the rack or by grasping weights that are resting on the rack, so that the rack and any weights supported thereon, slide horizontally.

A support bar is provided on the rack so that a spotter may push on the support bar to slide the rack and weights horizontally so that the weights are located vertically above the weight lifter. Alternately, if a spotter is not employed, the weight lifter may move the rack and weights horizontally so that the weights are directly above the bench by pulling forward on the rack or by pulling forward on the weights supported thereon. When the pushing or pulling force is removed from the rack, such as when the weights are lifted off the rack, the gas strut immediately returns the rack to its original, fully extended rearward position. In this position, the weight lifter can easily return the weights to the rack unaided. By holding the weights with his arms fully extended and then allowing the weights to move behind his head, the weight lifter moves the weights rearward until they again come to rest on the horizontal arms of the rack.

DETAILED DESCRIPTION OF THE PREFERRED EMBODIMENT INVENTION

Figure 1:
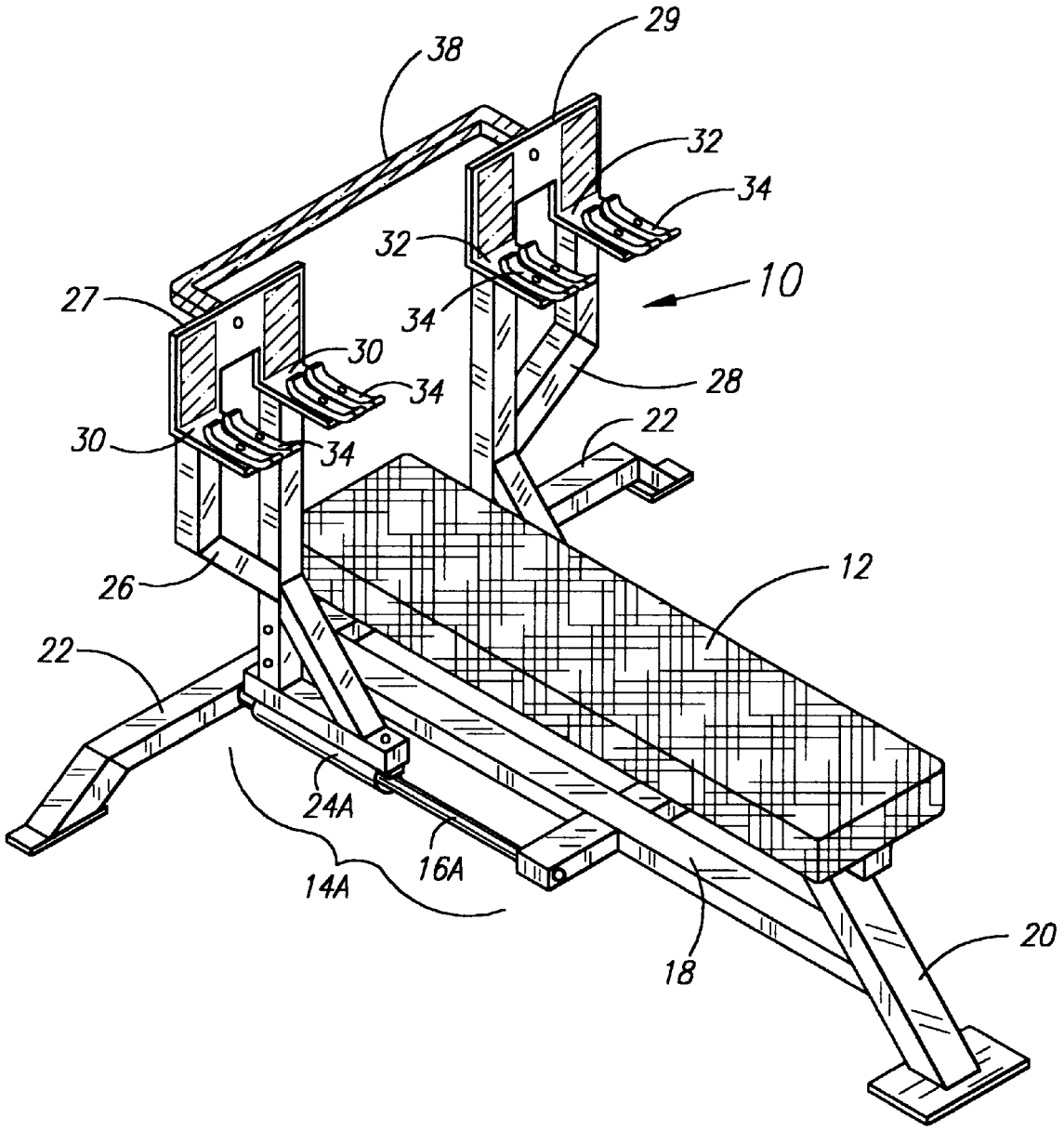
FIG. 1 is a perspective view of a slidable weight rack constructed in accordance with a preferred embodiment of the present invention, shown employed on a flat weight lifting bench.
Figure 2:
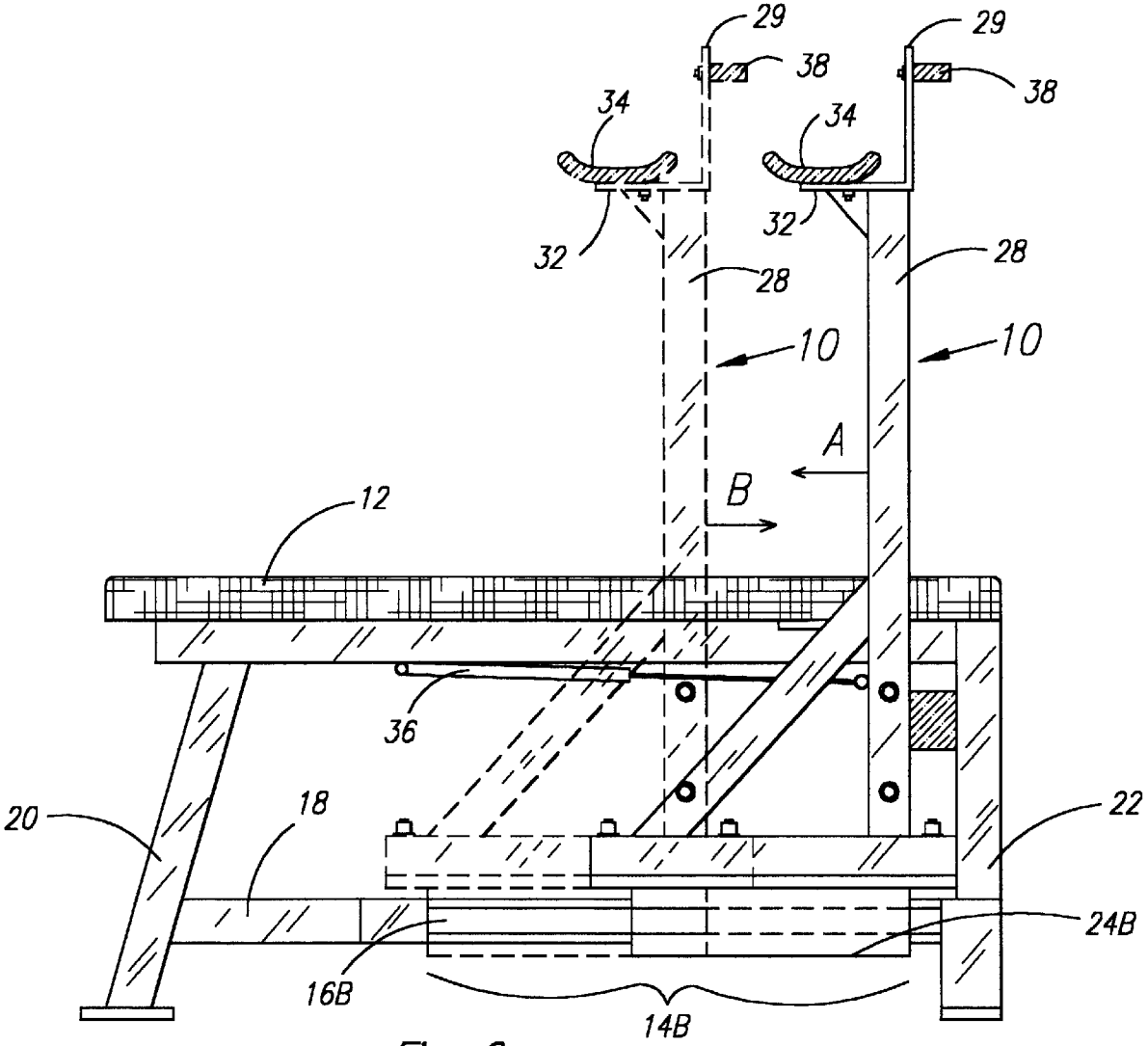
FIG. 2 is a left side elevation of the slidable weight rack and weight lifting bench of FIG. 1.

Referring now to the drawings, and initially to FIGS. 1 and 2, there is illustrated a slidable weight rack 10 constructed in accordance with a preferred embodiment of the present invention. The slidable rack 10 is attached to a horizontal weight lifting bench 12 by means of a pair of horizontally oriented linear bearings 14A and 14B that are provided below the bench 12. One bearing 14A or 14B is provided on either side of the bench 12.

A linear bearing shaft 16A or 16B of each of the linear bearings 14A and 14B is secured to the bench 12 via a horizontal brace 18 that extends between the supporting front leg 20 and rear supporting legs 22 of the bench 12. The rack 10 is secured to linear bearing housings 24A and 24B that are movably provided on their respective linear bearings 14A and 14B. The linear bearing housings 24A and 24B move longitudinally relative to their associated linear bearings 14A and 14B, and the rack 10 moves horizontally relative to the bench 12 in conjunction with the linear bearing housings 24A and 24B.

Figure 4:
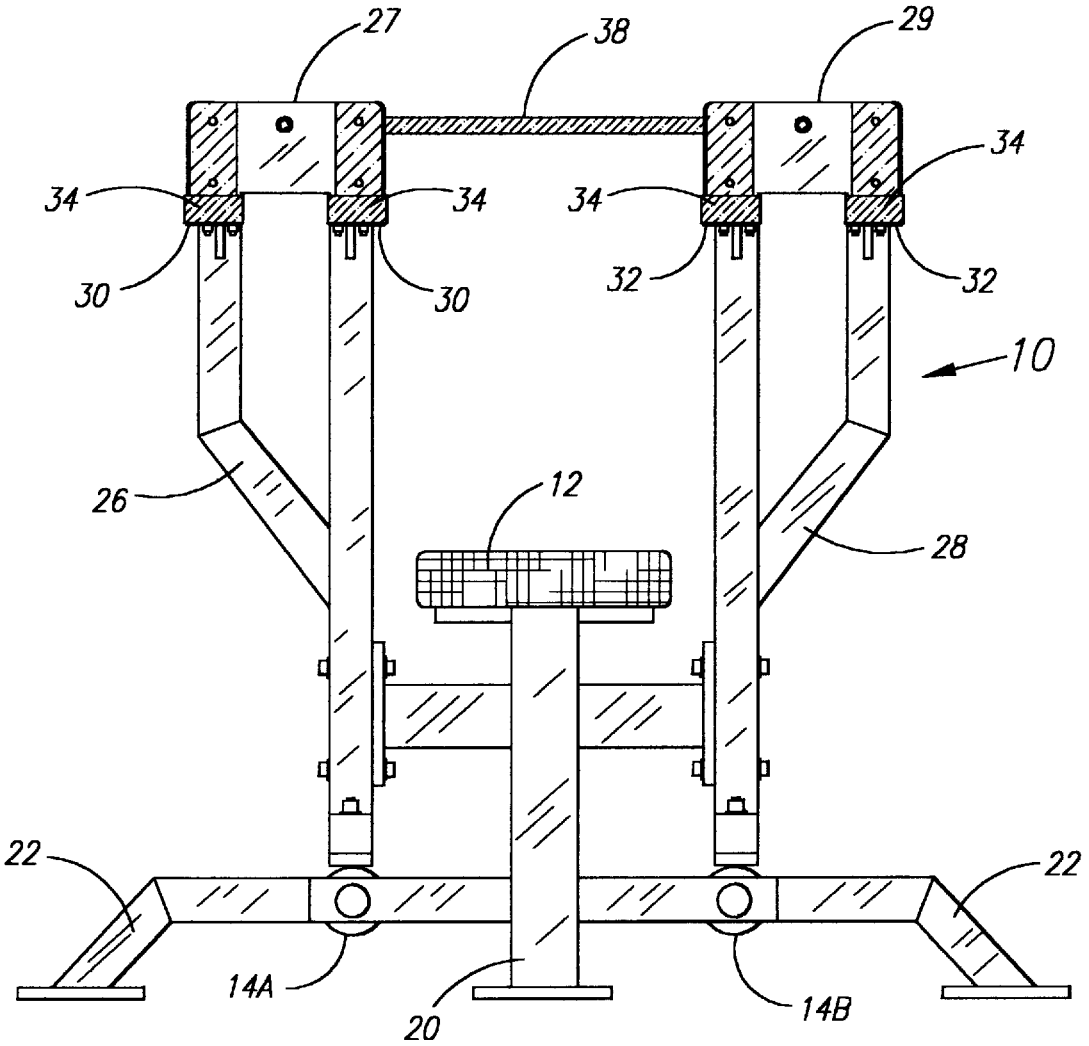
FIG. 4 is a front elevation of the slidable weight rack and weight lifting bench of FIGS. 1 through 3.

Referring also to FIG. 4, the rack 10 consists of two upright members 26 and 28 that extend vertically upward from the linear bearings 14A and 14B, and each upright member 26 and 28 is provided with a pair of horizontal arms 30 and 32 so that the horizontal arms 30 and 32 are somewhat below the upper ends 27 and 29 of the upright members 26 and 28. Each pair of horizontal arms 30 and 32 is provided with upwardly concave receiving rests 34 to cradle and hold therein a pair of free weights (not illustrated). Each pair of horizontal arms 30 and 32 is located above the bench 12 and extends forward in the direction of the bench 12. Free weights (not illustrated) are removably supported in the receiving rests 34 by the horizontal arms 30 and 32. The horizontal arms 30 and 32 and the rack 10 are movable, via the linear bearings 14A and 14B, longitudinally relative to the bench 12.

The rack 10 is normally biased in a fully extended rearward position, as illustrated in FIG. 1, by means of a gas strut 36 provided under the bench 12. The gas strut 36 is capable of exerting a biasing force of approximately ten pounds in order to slide the rack 10 rearward. Although the device is described employing a single gas strut 36, it is obvious that more than one gas strut may be employed, or alternately, any other suitable means for biasing the rack 10 rearward may be employed. The gas strut 36 is secured to both the rack 10 and the bench 12. The rack 10 can be easily pulled, either by grasping the rack 10 or by grasping weights (not illustrated) that are resting on the rack 10, so that the rack 10 and any weights supported thereon, slide horizontally.

Figure 3:
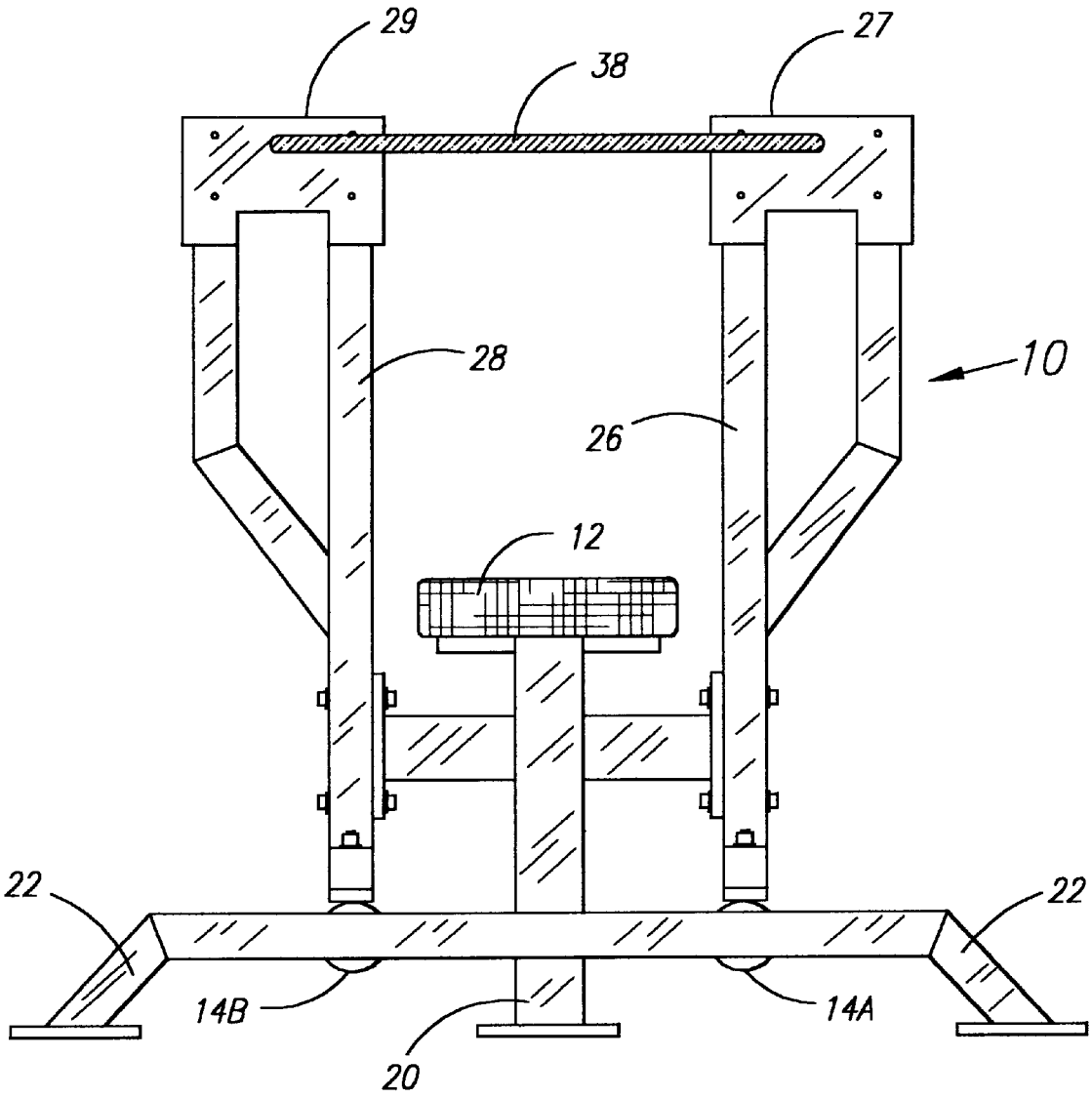
FIG. 3 is a rear elevation of the slidable weight rack and weight lifting bench of FIGS. 1 and 2.

Referring also to FIG. 3, a support bar 38 is provided on the rack 10 and extends between the two upright members 26 and 28. The support bar 38 is provided to stabilize the upright members 26 and 28 and to provide a handle by which a spotter (not illustrated) can grab the rack 10. A spotter (not illustrated) can grab the support bar 38 and can push on it to slide the rack 10 and weights (not illustrated) horizontally, as illustrated by Arrow A in FIG. 2, so that the weights (not illustrated) are located vertically above the bench 12. In this position, the weights (not illustrated) are above the weight lifter (not illustrated) who is lying, with his back down, on the bench 12, and the weight lifter (not illustrated) can grasp the weights (not illustrated) and lift them off the rack 10.

Alternately, if a spotter (not illustrated) is not employed, a weight lifter (not illustrated) may pull forward on weights (not illustrated) that are resting on the rack 10, thus moving them horizontally so that the weights (not illustrated) and the rack 10 are positioned directly above the bench 12. This forward position of the rack 10 is illustrated in FIG. 2 by the broken outline of the rack 10. Again, when the rack 10 is in this forward position, the weight lifter (not illustrated) can easily lift the weights (not illustrated) off the rack 10.

When either a pushing or pulling force is removed from the rack 10, such as when the weights (not illustrated) are lifted off the rack 10 by a weight lifter (not illustrated), the gas strut 36 immediately slides the rack 10, as illustrated by Arrow B in FIG. 2, along its linear bearings 14A and 14B to its original, fully extended rearward position. In this rearward position, the weight lifter (not illustrated) can easily return the weights (not illustrated) to the rack 10 unaided. By holding the weights (not illustrated) with his arms fully extended, the weight lifter (not illustrated) moves the weights (not illustrated) rearward until the weights (not illustrated) engage the upright members 26 and 28, then lowers the weights (not illustrated) until they again come to rest on the receiving rests 34 of the horizontal arms 30 and 32 of the rack 10.

Figure 5:
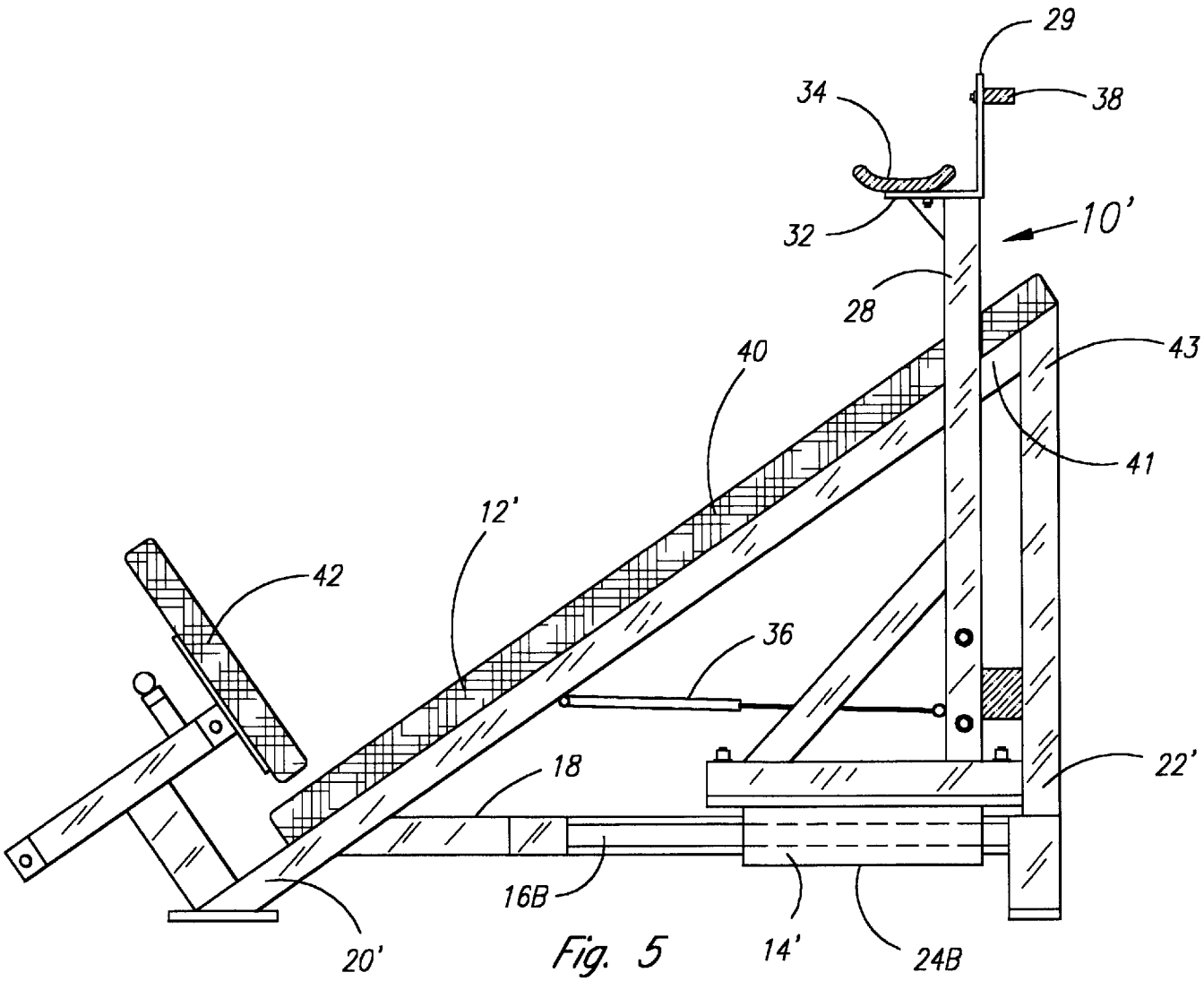
FIG. 5 is a second embodiment of the slidable weight rack, shown employed on a rearwardly elevated, inclined bench.

Referring now to FIG. 5, a second embodiment rack 10' is shown in association with a rearwardly elevated, inclined bench 12'. The rearwardly elevated, inclined bench 12' is provided with a back portion 40 on which a weight lifter (not illustrated) places his back and a seat portion 42 on which the same weight lifter (not illustrated) sits. In this embodiment, the back portion 40 of the bench 12' attaches directly to an inclined front leg 20' of the bench 12', and the inclined front leg 20' secures on its upper end 41 to an upper end of rear legs 22' of the bench 12'.

Figure 6:
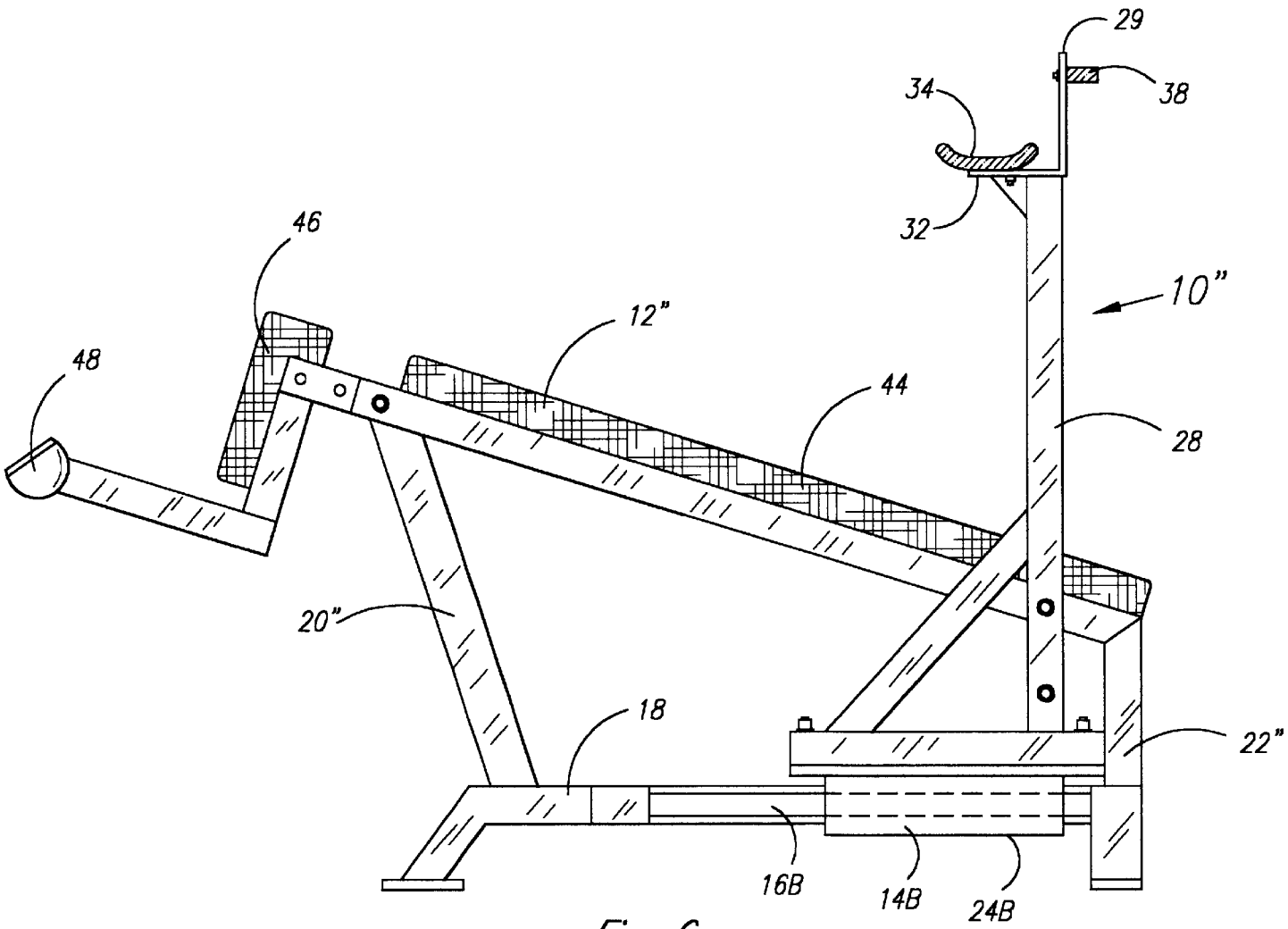
FIG. 6 is third embodiment of the slidable weight rack, shown employed on a forwardly elevated, declined bench.

Referring now to FIG. 6, a third embodiment rack 10" is shown in association with a forwardly elevated, declined bench 12". The forwardly elevated, declined bench 12" is provided with a bench portion 44 on which a weight lifter (not illustrated) lays, a leg portion 46 against which the calves of the same weight lifter's legs (not illustrated) rest, and a foot pad 48 under which the weight lifter's feet hook. In this third embodiment rack 10", the foot pad 48 attaches to the leg portion 46, and the leg portion 46 attaches to the bench portion 44. Also, a front leg 20" of the bench 12" is longer than rear legs 22" of the bench 12" so that the bench 12" is elevated by the front leg 20". The gas strut 36 is not visible in FIG. 6 since it is hidden by the bench 12".

Figure 7:
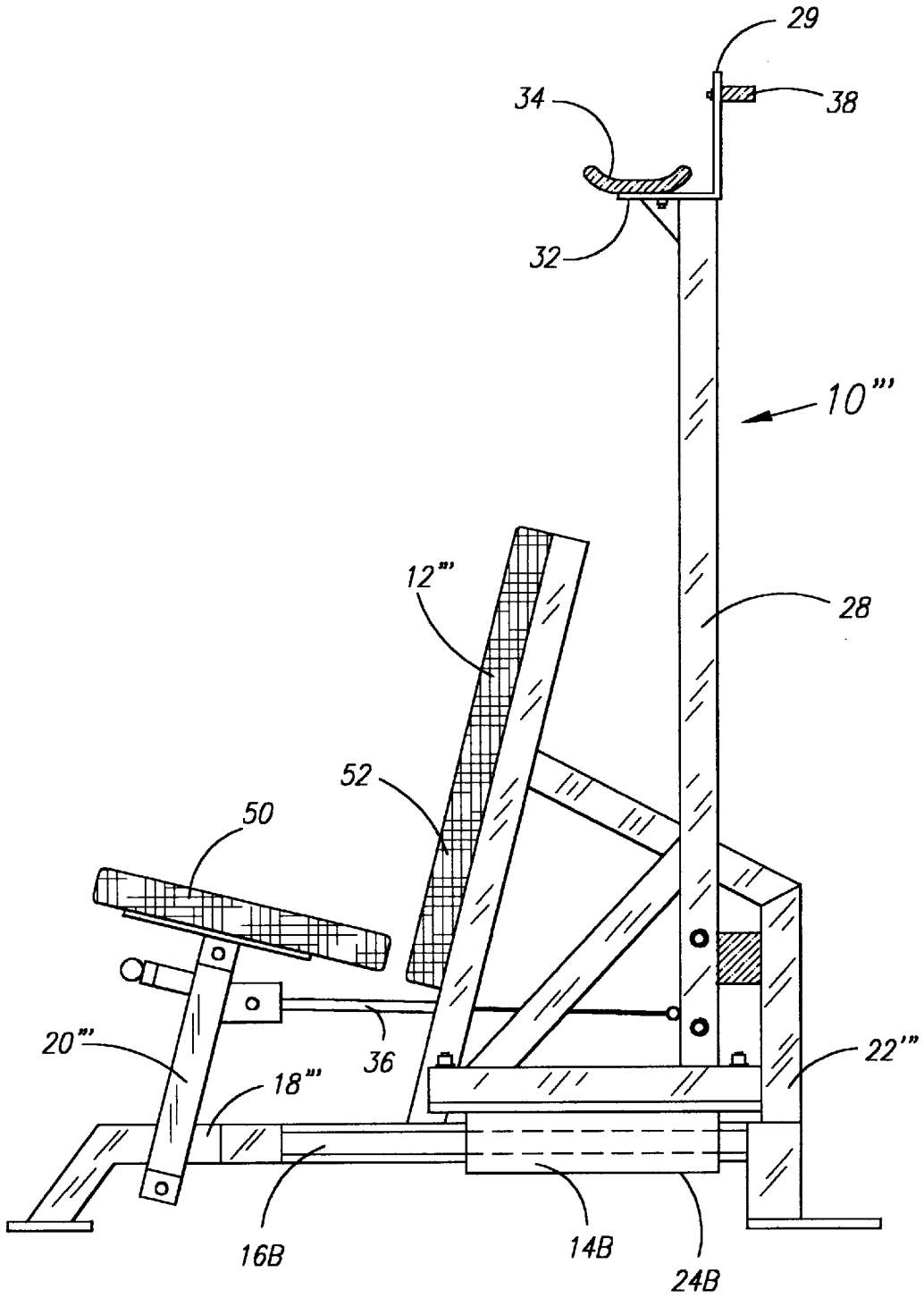
FIG. 7 is a fourth embodiment of the slidable weight rack, shown employed on an upright bench.

Referring now to FIG. 7, a fourth embodiment rack 10''' is shown in association with an upright bench 12'''. The upright bench 12''' is provided with a seat portion 50 and a back portion 52. The seat portion 50, on which a weight lifter (not illustrated) sits, attaches to a front leg 20''' of the bench 12''' and the back portion 52, against which the same weigh lifter's back rests, attaches to a horizontal brace 18''' and to rear legs 22''' of the bench 12'''.

Except for the modifications to the benches 12', 12", and 12''' described above, the second, third and fourth embodiment racks 10', 10", and 10''' are each the same as described previously for the rack 10.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A sliding weight rack and bench combination comprising:

a rack attached to and extending above a weight lifting bench for removably holding weights, said rack mounted for linear movement longitudinally relative to the bench, and a biasing mechanism for biasing said rack rearwardly relative to the bench.

2. A sliding weight rack according to claim 1 further comprising said rack slidably attached to said bench.

3. A sliding weight rack according to claim 2 further comprising said rack secured to a linear bearing housing of at least one linear bearing, and said bench secured to a linear bearing shaft of said at least one linear bearing as a means for allowing movement of said rack relative to said bench.

4. A sliding weight rack according to claim 3 further comprising at least one gas strut attached to said bench and attached to said rack so that the at least one gas strut biases the rack rearward relative to the bench.

5. A sliding weight rack according to claim 4 further comprising said rack being provided with horizontal arms extending forward relative to the bench for removably receiving weights thereon.

6. A sliding weight rack according to claim 4 wherein said bench is a horizontal bench.

7. A sliding weight rack according to claim 4 wherein said bench is a rearwardly elevated, inclined bench comprised of a seat portion on which a weight lifter sits and a back portion against which a weight lifter's back rests.

8. A sliding weight rack according to claim 4 wherein said bench is a forwardly elevated, declined bench comprised of a bench portion against which a weight lifter's back rests, a leg portion against which a weight lifter's legs rest, and a foot pad under which a weight lifter's feet hook.

9. A sliding weight rack according to claim 4 wherein said bench is an upright bench comprised of a seat portion on which a weight lifter sits and a back portion against which a weight lifter's back rests.

10. A sliding weight rack and bench combination comprising:

a bench on which a weight lifter rests, a rack for removably holding weights secured to and extending upward above the bench, said rack slidably engaging said bench so that said rack moves linearly and longitudinally relative to the bench, and a biasing mechanism which normally biases said rack rearward relative to the bench.

11. A sliding weight rack according to claim 10 further comprising said rack slidably engaging said bench by means of at least one linear bearing, and said rack biased rearward relative to said bench be means of at least one gas strut that is attached to the rack and to the bench.

12. A sliding weight rack according to claim 11 wherein said rack and said bench are each secured to two linear bearings.

13. A sliding weight rack according to claim 12 further comprising said rack being provided with horizontal arms extending forward relative to the bench for removably receiving weights thereon, said horizontal arms provided below an upper end of upright members provided on the rack, and receiving rests provided on said horizontal arms for removably receiving weights.

14. A sliding weight rack according to claim 13 wherein said bench is a horizontal bench.

15. A sliding weight rack according to claim 13 wherein said bench is a rearwardly elevated, inclined bench comprised of a seat portion on which a weight lifter sits and a back portion against which a weight lifter's back rests.

16. A sliding weight rack according to claim 13 wherein said bench is a forwardly elevated, declined bench comprised of a bench portion against which a weight lifter's back rests, a leg portion against which a weight lifter's legs rest, and a foot pad under which a weight lifter's feet hook.

17. A sliding weight rack according to claim 13 wherein said bench is an upright bench comprised of a seat portion on which a weight lifter sits and a back portion against which a weight lifter's back rests.

* * * * *